United States Patent [19]

Halverson

[11] Patent Number: 4,825,601

[45] Date of Patent: May 2, 1989

[54] MODULAR SLOTWALL MEMBERS

[76] Inventor: Lance K. Halverson, 7047 - 27th NW., Seattle, Wash. 98117

[21] Appl. No.: 127,637

[22] Filed: Dec. 2, 1987

[51] Int. Cl.[4] ..... E04C 1/10

[52] U.S. Cl. ..... 52/36; 52/38; 52/239; 52/588; 211/87; 211/94; 211/189; 248/222.2; 248/225.2

[58] Field of Search ..... 52/36, 38, 238.1, 239, 52/242, 536, 537, 542, 588; 211/87, 94, 189; 248/220.2, 220.3, 220.4, 222.2, 225.2

[56] References Cited

U.S. PATENT DOCUMENTS

| | | | |
|---|---|---|---|
| 2,319,278 | 5/1943 | Urbain . | |
| 2,679,700 | 6/1954 | Urbain . | |
| 2,947,093 | 8/1960 | Masters . | |
| 3,008,249 | 11/1961 | Masters . | |
| 3,557,499 | 1/1971 | Dickie et al. . | |
| 4,211,379 | 7/1980 | Morgan et al. . | |
| 4,509,648 | 4/1985 | Gonang et al. | 211/87 X |
| 4,531,331 | 7/1985 | Itagaki | 52/38 |
| 4,579,308 | 4/1986 | Jensen | 52/36 X |
| 4,591,058 | 5/1986 | Amstutz et al. | 52/36 X |
| 4,598,504 | 7/1986 | Itagaki | 52/36 |
| 4,607,753 | 8/1986 | Rader | 52/36 X |
| 4,674,240 | 7/1987 | Stausheim | 52/36 |
| 4,694,965 | 9/1987 | Parnell | 52/36 X |
| 4,726,554 | 2/1988 | Sorrell | 211/87 X |

FOREIGN PATENT DOCUMENTS

| | | | |
|---|---|---|---|
| 2028649 | 3/1980 | United Kingdom | 248/222.2 |

OTHER PUBLICATIONS

A one page brochure entitled "RolfRak" by RolfRak, Inc., published about Nov. 1, 1982.

A one page brochure entitled "RolfRak", by RolfRak, Inc., published about Aug. 1, 1983.

*Primary Examiner*—Carl D. Friedman

*Assistant Examiner*—Richard E. Chilcot, Jr.

*Attorney, Agent, or Firm*—Gregory W. Moravan

[57] ABSTRACT

Modular slotwall members for use with face boards to form a modularized slotwall of any desired size on a wall. The upper and lower edges of the face boards are received in the upper and lower face board channels of adjacent modular slotwall members. Each modular slotwall member is provided with a slot sized to releasably hold a slotwall display fixture. The face board channels in the modular slotwall members are sized, shaped and arranged to enable face boards of different thicknesses to be used, to help ensure the upper and lower edge portions of the face boards contact the front edges of their respective face board channels for a neat appearance, to permit face boards with conventional rectangular edges to be used without modification, and to permit the face boards to be easily inserted into and removed from the face board channels of the installed modular slotwall members for repair, replacement and reversal. In another form of the invention, a modularized slotwall is provided in which the slotwall members and faceboards are mounted to the support boards by the use of keyholes in the support boards which mate with headed connectors for the slotwall members and faceboards.

12 Claims, 3 Drawing Sheets

MODULAR SLOTWALL MEMBERS

BACKGROUND OF THE INVENTION

The present invention relates to slotwalls for displaying goods, and more particularly it relates to modular slotwall members used in making a modularized slotwall.

SUMMARY OF THE INVENTION

One of the objects of the present invention is to provide attractive, low cost, strong, durable easy to install modular slotwall members which can be used with face boards to provide a slotwall which can easily be made in any desired size.

In basic form, the modular slotwall members of the present invention each comprise, from top to bottom an upper face board channel, an L-shaped slot for receiving a conventional slotwall display fixture, a face wall, and a lower face board channel.

Although a single slotwall member could be used alone, more typically a slotwall would be built up from at least two slotwall members between which is supported a face board. The upper edge of each face board is held by the lower face board channel of the slotwall member immediately above it, while the lower edge of each face board is held by the upper face board channel of the slotwall member immediately below it. The present invention is very versatile. This is because the height of the modularized slotwall is governed by the number and size of the slotwall members and faceboards used in it in a vertical direction. In addition, the length of the modularized slotwall is governed by the number and length of the slotwall members and face boards used in it in a horizontal direction.

Preferably, the size of the face board channels in the slotwall members, the distance between installed slotwall members, and the height of the face boards are selected to permit the face boards to be easily removed from and inserted into the slotwall members after the slotwall members have been installed on a wall. This enables the realization of other objects of the present invention which are to permit easy repair and replacement of the face boards in the installed slotwall; and to enable the face boards (which may have their front and back faces painted differently) to be easily turned over to reveal their previously hidden faces, to give the slotwall a new decorative look.

Another object of the present invention is to permit the use of very thin face boards, thereby reducing the cost as compared to when thicker face boards are used. This object is helped to be achieved by providing sturdy slotwall members which carry all loading, thereby enabling face boards to be used which are so thin that they are only strong enough to support their own weight. Thus, for example, face boards made from stiff paper or cardboard could be used, although for durability more substantial face boards made from wood, metal or plastic are preferred.

For a neat, attractive appearance the bottom wall of the upper face board channel in each slotwall member is preferably inclined downwardly from back to front. This enables the lower portion of each face board to be urged to move under the influence of gravity towards and against the front wall of its respective upper face board channel in the slotwall member immediately beneath it, to help to eliminate any unsightly gap which might otherwise exist therebetween.

Similarly, it is preferred that the lower face board channel in each slotwall member be provided with an internal flange which will help urge any very thin face board which it holds towards its front wall, for a neat appearance.

It is also preferred that the upper and lower face board channels in each slotwall member be offset from each other, with the upper face board channel extending further from the wall upon which the slotwall is installed than does the lower face board channel. Such a construction helps to tip each installed face board slightly so that its lower edge is further from the wall than is its upper edge. This helps to ensure that the upper portion of the installed face board will tend to contact the front, lower edge of its respective lower face board channel in the slotwall member immediately above it, for a neat appearance. Alternatively, said upper and lower face board channels need not be offset from each other.

Other objects of the present invention are to permit face boards of various thicknesses to be used with the slotwall members of the present invention; and to permit face boards with conventional rectangular edges to be used, since no special milling of their edges is needed.

In another form of the invention, a modular slotwall is provided comprising one or more support boards, each having an array of keyholes provided therein. One or more slotwall members are also provided, each having a display fixture slot for receiving display fixtures and a connector slot. Each slotwall member is secured in any desired location on its respective support board by a plurality of double headed connectors, each having one head engaged in a respective keyhole in its respective support board and its other head engaged in its respective slotwall member's connector slot. One or more face boards are also provided, each having a respective array of headed connectors is secured to its back face. Each face board is secured in any desired location on its respective support board by engaging the heads of its connectors in respective keyholes in its support board.

The modular slotwall can be made in any desired size, it can be mounted to an existing wall, and it can be made free standing so both of its sides are useable.

The foregoing is intended to be but a brief description of, and not a detailed catalog of, the various objects, features, advantages and characteristics of the present invention, since these and further objects, features, advantages and characteristics of the present invention will be expressly or inherantly disclosed to those skilled in the art to which the present invention pertains, in view of all of the disclosures herein.

DESCRIPTION OF THE PREFERRED EMBODIMENTS

Figure 1:
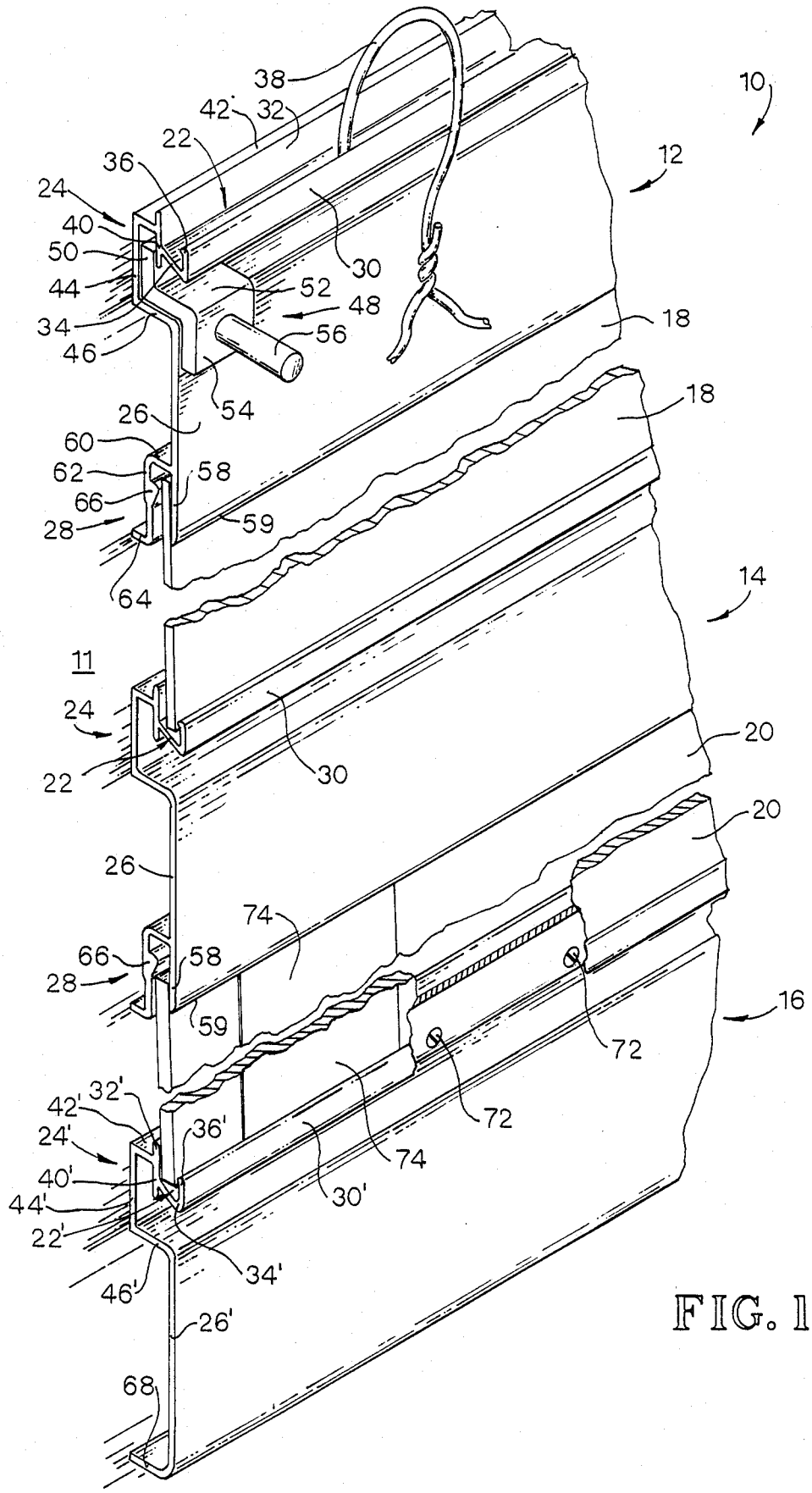
FIG. 1 is an end perspective view showing the present invention mounted to a wall.

Referring to the Figure, a slotwall, generally designated at 10, is illustrated mounted on a flat wall 11. By way of non-limiting example, slotwall 10 comprises identical upper and middle slotwall members 12, 14, a lower slotwall member 16, an upper face board 18, and a lower face board 20.

Upper slotwall member 12 comprises, from top to bottom, upper face board channel 22, L-shaped display fixture slot 24, face wall 26, and lower face board channel 28.

Upper face board channel 22 has a vertical front wall 30, vertical back wall 32, and a bottom wall 34 which is preferably inclined downwardly from back wall 32 to front wall 30, as seen. Front wall 30 has a bead 36 to help prevent it from marring any face boards 18, 20 with which upper face board channel 22 may be used. As seen in the figure, if upper face board channel 22 of upper slotwall member 12 is left empty, because it is desired that no face board 18, 20 be used with it, then upper face board channel 22 may be used to support hangers 38, or the like, for merchandise such as shirts, coats, etc.

L-shaped display fixture slot 24 has a vertical front wall 40, horizontal top wall 42, vertical back wall 44 and horizontal bottom wall 46. A portion of its front wall 40 forms part of back wall 32 of upper face board channel 22. It's top wall 42 is narrower than its bottom wall 46, thereby locating the plane of its front wall 40 rearwardly of the plane of face wall 26. L-shaped display fixture slot 24 is sized, as seen, to releasably receive in the conventional fashion a conventional display fixture 48 having a vertical back 50, horizontal seat 52, vertical foot 54 and a forwardly projecting display rod 56. To remove display fixture 48, its display rod 56 is rotated upwardly and tugged gently until its back 50 clears front wall 40 of L-shaped slot 24. The installation of display fixture 48 in L-shaped slot 24 is simply the reverse of the way it is removed from L-shaped slot 24.

Lower face board channel 28 has a vertical front wall 58, a horizontal top wall 60, and a vertical back wall 62. Extending back from the bottom of back wall 62 is a short support leg 64 whose terminal edge is coplanar with the plane of back wall 44 of L-shaped display fixture slot 24. Back wall 62 also includes a forwardly projecting flange 66 whose purpose will be discussed below.

Face wall 26 lies between and interconnects bottom wall 46 of fixture slot 24 and front wall 58 of lower face board channel 28. The vertical length of face wall 26 may be selected as desired. In fact, face wall 26 might even be eliminated, in which case front wall 58 of lower face board channel 28 would project downwardly directly from bottom wall 46 of fixture slot 24.

As has been mentioned, middle slot wall member 14 is identical to upper slotwall member 12. Thus, all of the features and descriptions contained herein regarding upper slotwall member 12 apply equally well to middle slotwall member 14.

Lower slotwall member 16 is also the same as upper slotwall member 12, except that lower face board channel 28 with its top wall 60, back wall 62, flange 66 and short support leg 64 have been eliminated; and a long support leg 68 has been added. In lower slotwall member 16, its face wall 26' has a vertical length equal to the combined lengths of face wall 26 and front wall 58 of upper slotwall member 12. For clarity, parts of lower slotwall member 16 which correspond to those of upper slotwall member 12 have been given the same reference numerals, but with a prime appended thereto.

Each slotwall member 12, 14, 16 is secured to wall 11 by the use of a plurality of screws 72 which pass through their back walls 44, 44'. Each slotwall member 12, 14, 16 is preferably made as an extrusion from aluminum, and has a uniform cross sectional configuration throughout its length.

After slotwall members 12, 14, 16 have been secured to wall 11 in their desired locations, face board 18 is then mounted between slotwall members 12, 14. This is done by first inserting the upper edge of face board 18 up into the lower face board channel 28 of the upper slotwall member 12 located immediately above it until face board 18's lower edge clears the top of the front wall 30 of upper face board channel 22 in the middle slotwall member 14 located immediately below it. The lower edge of face board 18 is then pushed back to automatically index against back wall 32, and is then dropped into the upper face board channel 22 of middle slotwall member 14 located immediately below it, thereby completing its installation. Similarly, removal of face board 18 from slotwall members 12, 14 is done by reversing the above installation procedure. The installation and removal of face board 20 is similar to the installation and removal of face board 18.

Since slotwall members 12, 14, 16 bear all of the loading of all of the merchandise displayed on slotwall 10, face boards 18, 20 could be made only strong enough to support their own weight, thereby permitting them to be made even from stiff paper or cardboard. For more durable face boards 18, 20 stronger materials such as wood, metal or plastic are preferred. In addition, as seen, face boards with conventional rectangular edges are used, since no special milling of their edges are needed.

As seen in the figure, bottom walls 34, 34' of upper face board channels 22, 22' incline downwardly towards their front walls 30, 30'. This is to help the lower edges of face boards 18, 20 to automatically slide down and forward, under the influence of gravity in their respective upper face board channels 22, 22' until their front surfaces rest against beads 36, 36' of their respective upper face board channels 22, 22', for a neat appearance. This action occurs with both face boards 18 and 20, even though they are of different thicknesses.

As also seen in the figure, upper and lower face board channels 22, 22', 28 are offset from each other, with upper face board channels 22, 22' being located farther forward, away from wall 11, than are lower face board channels 28. The plane of the front walls 58 of lower face board channels 28 approximately bisect upper face board channels 22, 22'. The offset of the upper and lower face board channels 22, 22', 28 causes the installed face boards 18, 20 to tip slightly so their bottom edges are further from wall 11 than are their top edges. This helps the top portions of the front surfaces of face boards 18, 20 to contact the lower edges 59 of the front walls 58 of their respective lower face board channels 28 in the slotwall members 12, 14 immediately above them, for a neat appearance.

When a thin face board 18 is used, its vertical length is selected, as seen in the figure, so its top edge is above flange 66 in the lower face board channel 28 in the slotwall member 12 immediately above it. Flange 66's function is to help urge the top portion of thin face board 18 forward, into contact with the lower edge 59 of front wall 58 of lower face board channel 28 in the slotwall member 12 immediately above it, for a neat appearance.

When a thick face board 20 is used, its vertical length is selected, as seen in the figure, so its top edge is below flange 66 in the lower face board channel 28 in the slotwall member 14 immediately above it. Because face board 20 is relatively thick, the offset of upper and lower face board channels 22, 22', 28, which was described above, is enough to cause its front surface to contact the lower edge 59 of front wall 58 of the lower face board channel 28 in the slotwall member 14 immediately above it, for a neat appearance.

Because upper and lower face board channels 22, 22', 28 can be made as narrow as desired, face boards 18, 20 as thin as one quarter of an inch, or less, can be used, thereby significantly reducing the cost of face boards 18 20 as compared to when much thicker face boards 18 20 are used.

Face boards 18, 20 and their upper and lower face board channels 22, 22', 28 are sized to permit advertising material, such as a poster 74, to be easily inserted and removed between face boards 18, 20 and the outer walls 30, 30', 58 of the upper and lower face board channels 22, 22', 28.

If desired, the opposite faces of each face board 18, 20 may be painted with different colors, pictures, designs, etc. As a result, the user can easily change the look of slotwall 10 by merely removing, turning over and reinstalling face boards 18, 20 in their slotwall members 12, 14, 16.

Because of the modular design of the components used to make slotwall 10, it will now be apparent that slotwall 10 could easily be made as tall or as short as desired by merely increasing or decreasing the number and size of slotwall members 12, 14, 16 and face boards 18, 20 which are used. Similarly, the length of slot wall 10 is easily made as long or as narrow as desired by merely increasing or decreasing the number and length of slotwall members 12, 14, 16 and face boards 18, 20 which are used. Slotwall members 12, 14, 16 and face boards 18, 20 can be prefabricated in any desired length(s) and width(s). Such modularity is also desireable because it permits the size of an existing slotwall 10 to be easily increased or decreased, as the user's changing needs dictate.

If desired, an upper slotwall member 12 could be used as the lower slotwall member 16 in slotwall 10 instead of using the lower slotwall member 16 which is actually illustrated in the figure.

Figure 2:
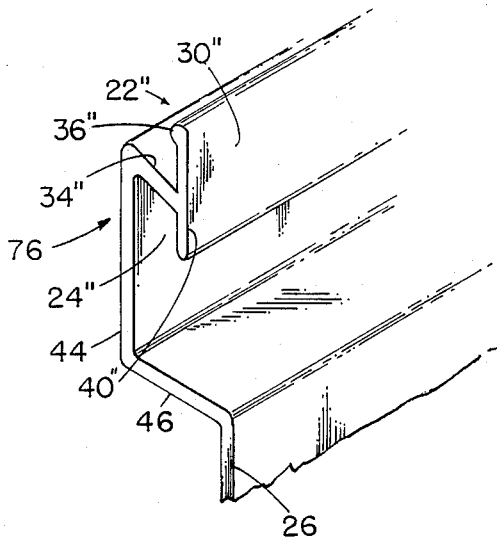
FIG. 2 is an end perspective view of a modified slotwall member.

Referring now to FIG. 2, it shows another form 76 of FIG. 1's slotwall members 12,14. Slotwall member 76 is identical to slotwall members 12, 14, in construction and function, except for the differences which will now be addressed. For clarity, parts of slotwall member 76 which are identical to those of slotwal members 12, 14 are given the same reference numerals; while those parts which are similar will be given the same reference numerals, but with a double prime appended thereto.

To form slotwall member 76, the inclined bottom wall 34 of upper faceboard channel 22 of slotwall member 12, 14 of FIG. 1 has been moved back and secured directly to the top of the back wall 44 of display fixture slot 24, so that in slotwall member 76 of FIG. 2, upper faceboard channel 22'' is defined by inclined wall 34'' and front wall 30''. Further, the front wall 40 of the display fixture slot 24 of FIG. 1 has been changed to become a front wall 40'' which extends downwardly from front wall 30'', as seen in FIG. 2, so that in slotwall member 76 the display fixture slot 24'' is defined by bottom wall 46, back wall 44, inclined wall 34'' and front wall 40''. Thus, in slotwall member 76, its upper faceboard channel 22'' is not offset to be in front of its lower faceboard channel 28.

Figure 3:
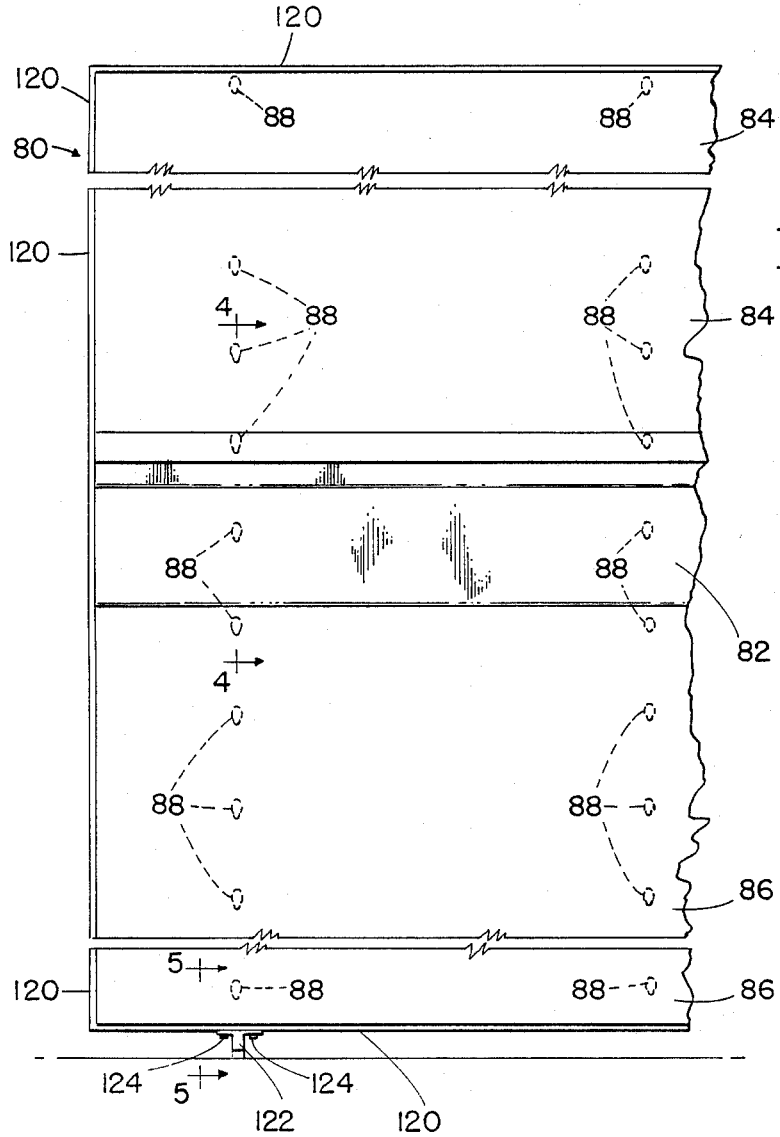
FIG. 3 is a front elevation view of another form of modular slotwall.
Figure 4:
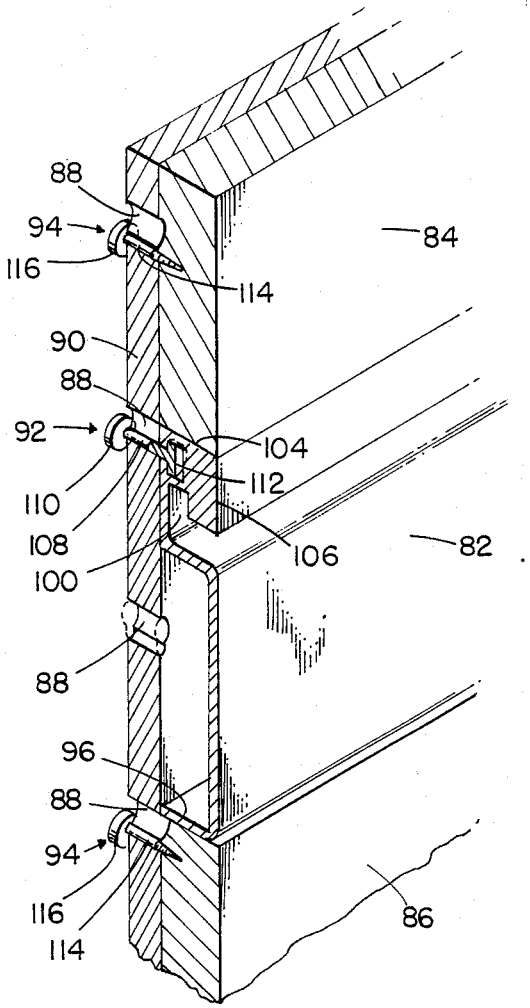
FIG. 4 is a perspective cross-sectional view taken along line 4—4 of FIG. 3 of the front half of a double modular slotwall.
Figure 5:
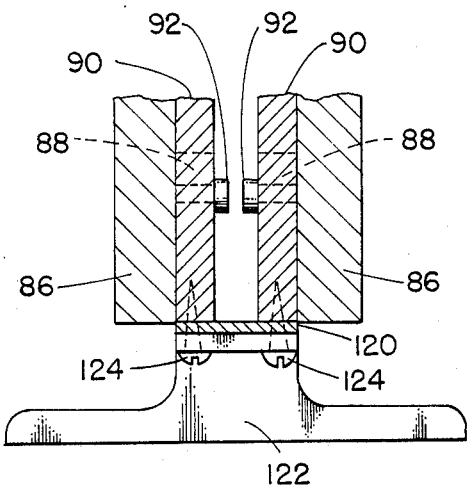
FIG. 5 is a cross-sectional view taken along line 5—5 of FIG. 3.

Turning now to FIGS. 3–5, another form of modular slotwall construction 80 is illustrated which comprises one or more slotwall members 82 and one or more faceboards 84, 86 which are removeably mounted to keyholes 88 in support board 90 with connectors 92, 94, respectively. Support board 90 may be made in any desired size. Although keyholes 88 are preferred, keyholes 88 could be simply circular shaped holes.

Slotwall member 82, which may be integrally formed as an aluminum extrusion, comprises a support leg 96, a lower front wall 98, an L-shaped fixture slot 100, a T-shaped connector slot 102, a top wall 104 and an upper front wall 106. Elements 96, 98 and 100 are the same in construction and function as elements 68, 26' and 24', respectively, of FIG. 1. Slotwall member 82 can be made in any desired size.

As best seen in FIGS. 3 and 4, support board 90 is provided with a regularly spaced array of keyholes 88. Slotwall member 82 is secured in any desired location on support board 90 by the use of a plurality of dumbell-shaped connectors 92. Each connector 92 has a cylindrical stem 108 with flat, circular heads 110, 112 at each end. To mount slotwall member 82 to support board 90, first the heads 110 of a plurality of connectors 92 are engaged in respective keyholes 88 in support board 90, as seen. Then slotwall member 82 is slid horizontally across the face of support board 90 in its desired location until its connector slot 102 has engaged all of the heads 112 of its respective connectors 92, as seen.

Faceboards 84, 86 are each provided with a plurality of connectors 94, each having a threaded stem 114 screwed into a respective faceboard 84, 86, and having a flat, circular head 116. The spacing of connectors 94 on faceboards 84, 86 matches the spacing of keyholes 88 in support board 90. To mount faceboards 84, 86 to support board 90, the heads 114 of their connectors 94 are simply mounted in their respective keyholes in the desired location on support board 90 as seen. Faceboards 84, 86 can also be made in any desired size from any durable, reasonably rigid material such as wood, plastic or metal. Faceboards 84, 86 can be painted in any desired color or design for an attractive appearance, they can be padded, and they can be covered with fabric, as desired by the user.

Slotwall 80 is assembled to support board 90 from the bottom up, because the shape of keyholes 88 requires the heads 110, 114 of connectors 92, 94 to be inserted into the large, upper opening of keyholes 88 before their stems 108, 114 are lowered into the small lower openings of keyholes 88. Alternatively, the edges of faceboards 84, 86 adjacent slotwall member 82 may be padded sufficiently to provide enough give so that the members 82, 84, 86 of slotwall 80 can be assembled to or disassembled from support board 90 in any order.

From the foregoing, it will be apparent that the connector slot 102 of slotwall member 82 could be eliminated, thereby permitting slotwall member 82 to be mounted to support board 90 by the use of connectors 94 instead of connectors 92. In such case the stems 114 of connectors 94 would be secured to the upper portion of slotwall member 82 where the stems 108 of connectors 92 are presently shown to be located in FIG. 4.

Similarly, faceboards 84, 86 could be mounted to support board 90 by the use of connectors 92, instead of connectors 94, by routing one or more T-shaped connector slots 102 in faceboards 84, 86 where the stems 114 of connectors 94 are presently shown to be located in FIG. 4.

Support board 90 may be mounted to an existing wall by any suitable means, such as with screws, as long as spacers or other means are used to provide a space between the existing wall and support board 90 sufficient to accommodate the heads 110, 116 of connectors 92, 94.

Alternatively, support board 90 may be made free standing by securing to its lower portion any conventional support feet sufficient to support it in an erect posture.

Alternatively, as seen in FIGS. 3 and 5, a free standing, double sided modular slotwall 80 may be provided which comprises a pair of support boards 90 secured together, with a space 118 between them, by a peripheral trim strip 120 which is secured to support boards 90 by a plurality of fasteners such as screws. Each support board 90 is provided with an array of keyholes 88, as has been described. Thus, one or more slotwall members 82 and one or more faceboards 84, 86 may be secured with connectors 92, 94 to either or both of the pair of support boards 90. Space 118 is selected to be wide enough to accommodate the heads 110, 116 of connectors 92, 94, even when they are directly opposite each other. Double sided slotwall 80 may be provided with a plurality of support feet 122 which are secured with fasteners 124 to trim strip 120 and/or to support boards 90, as seen.

From the foregoing, various further applications, modifications and adaptations of the present invention will now be apparent to those skilled in the art to which it pertains, within the scope of the following claims.

What is claimed is:

1. A modular slotwall comprising:

at least one support member, wherein said at least one support member defines a plurality of holes;

at least one slotwall member, wherein said at least one slotwall member defines a display fixture slot;

at least one faceboard member;

a plurality of slotwall connector means for removeably mounting said at least one slotwall member in a desired location selected on said at least one support member; wherein each said slotwall connector means is adapted to removeably engage a respective said hole in said at least one support member; and a plurality of faceboard connector means for removeably mounting said at least one faceboard member in a desired location selected on said at least one support member; wherein each said faceboard connector means is adapted to removeably engage a respective said hole in said at least one support member.

2. A modular slotwall according to claim 1, wherein said at least one faceboard member includes at least one edge portion which is resiliently deformable enough to permit said at least one faceboard member to be installed on and removed from said support member while said at least one slotwall member which is located adjacent said at least one edge portion remains in place on said support member.

3. A modular slotwall according to claim 1, wherein at least one of said faceboard connector means includes a first faceboard connector means head which is adapted to removeably engage a respective said hole in said at least one support member; and wherein at least one of said slotwall connector means includes a first slotwall connector means head which is adapted to removeably engage a respective said hole in said at least one support member.

4. A modular slotwall according to claim 3, wherein at least one of said respective holes in said at least one support member are keyholes.

5. A modular slotwall according to claim 3, wherein said at least one slotwall member further defines a connector slot extending the full length of said at least one slotwall member;

wherein at least one of said slotwall connector means further includes a second slotwall connector means head connected to said first slotwall connector means head by a stem; and wherein said second slotwall connector means head is adapted to removeably engage said connector slot in said slotwall member.

6. A modular slotwall according to claim 5, wherein at least one of said respective holes in said at least one support member are keyholes.

7. A modular slotwall according to claim 3, wherein said at least one faceboard member further defines a connector slot extending the full length of said at least one faceboard member;

wherein at least one of said faceboard connector means further includes a second faceboard connector means head connected to said first faceboard connector means head by a stem; and wherein said second faceboard connector means head is adapted to removeably engage said connector slot in said faceboard member.

8. A modular slotwall according to claim 7, wherein at least one of said respective holes in said at least one support member are keyholes.

9. A modular slotwall according to claim 3, wherein at least one of said faceboard connector means has a stem extending outwardly from said first faceboard connector means head; and wherein said, stem is secured to said at least one faceboard.

10. A modular slotwall according to claim 9, wherein at least one of said respective holes in said at least one support member are keyholes.

11. A modular slotwall according to claim 3, wherein at least one of said slotwall connector means has a stem extending outwardly from said first slotwall connector means head; and wherein said stem is secured to said at least one slotwall.

12. A modular slotwall according to claim 11, wherein at least one of said respective holes in said at least one support member are keyholes.

* * * * *